United States Patent [19]

Pozzebon et al.

[11] Patent Number: 4,788,782

[45] Date of Patent: Dec. 6, 1988

[54] FOOT PRESSER DEVICE, PARTICULARLY FOR SKI BOOTS

[75] Inventors: Adolfo Pozzebon, Sala d'Istrana; Renzo Balbinot, Vittorio Veneto; Riccardo Perotto, Volpago del Montello, all of Italy

[73] Assignee: Nordica SPA, Montebelluna, Italy

[21] Appl. No.: 55,956

[22] Filed: Jun. 1, 1987

[30] Foreign Application Priority Data

Jun. 11, 1986 [IT] Italy ..... 82544 A/86

[51] Int. Cl.[4] ..... A43B 5/04; A43B 23/26

[52] U.S. Cl. ..... 36/119; 36/54

[58] Field of Search ..... 36/117–121, 36/54, 55, 114

[56] References Cited

U.S. PATENT DOCUMENTS

| | | | |
|---|---|---|---|
| 4,132,016 | 1/1979 | Vaccari | 36/114 |
| 4,253,251 | 3/1981 | Salomon | 36/119 |
| 4,583,306 | 4/1986 | Paris | 36/119 |
| 4,670,999 | 6/1987 | Olivieri | 36/119 |

OTHER PUBLICATIONS

WO85/03207 8/1985 WIPO Spademan 36/119.

*Primary Examiner*—James Kee Chi

*Attorney, Agent, or Firm*—Guido Modiano; Albert Josif

[57] ABSTRACT

A foot presser device, particularly for ski boots, composed of at least one presser connected to a wedge on which the foot rests. The presser is acted upon by actuating means in order to exert a selected pressure on the foot. The presser spans the foot entirely and is connected to the wedge in at least one point.

7 Claims, 2 Drawing Sheets

1
2
3
4
5
6
7
10
11
12
13
15
16
16a 1
4
10
11
12
13
15
16
18

1
4
6
7
9
10
11
12
13
15
16
17

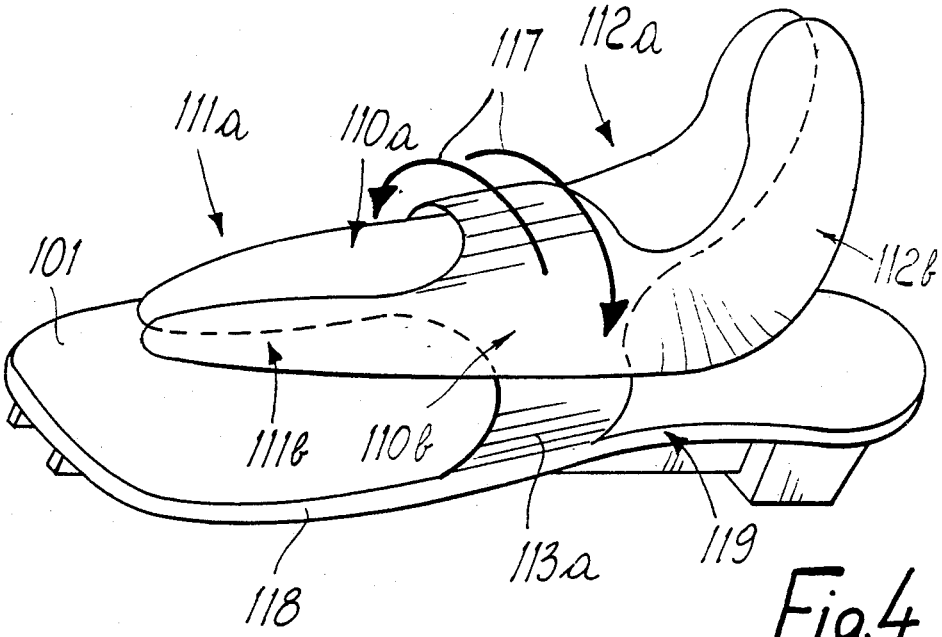
Fig. 4
Fig. 5
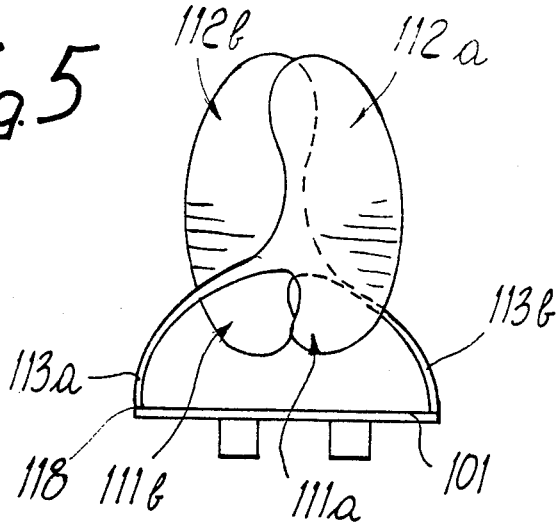

FOOT PRESSER DEVICE, PARTICULARLY FOR SKI BOOTS

BACKGROUND OF THE INVENTION

The present invention relates to a foot presser device, particularly for ski boots.

Ski boots are currently known which are provided, usually between the outer shell and the inner shoe, with foot pressers.

Said pressers are constituted by a rigid element, which can, for example, be obtained by monolithic moulding of the ski book shell or be fixed to the wedge, to the inner shoe or to the shell; the pressers are generally anatomically shaped with respect to the region of the instep or of the front of the foot.

Each of said pressers performs its action by means of adapted and independent pneumatic or mechanical devices operatable by the skier.

The main disadvantage which can be observed in each of these known types of pressers resides in the fact that they individually affect a well-defined and limited portion of the foot, i.e. the instep or the front of the foot.

Their action is thus very limited in scope, subjecting the foot to a pressure that is not evenly distributed but localized in certain parts.

As a partial solution to these disadvantages, ski boots are known which are provided with pressers both at the boot instep region and at the front of the foot: this solution, however, forces the use of two separate devices which, besides increasing the overall cost, impose a non-gradual distribution of pressure on the foot, the pressers being independent from one another.

SUMMARY OF THE INVENTION

The main aim of the present invention is thus to eliminate the disadvantages described above in known types, by devising a foot presser device which ensures an even distribution of the pressure from the foot instep to the front of the foot.

Within the scope of this aim, a further important object is to provide a foot pressure device which is applicable inside the ski boot rapidly and reliably.

Another object is to provide a foot presser device which allows the skier to achieve an optimum fit, thus allowing him to ski in a similarly optimum manner, it being possible to transmit every slight effort of the foot immediately to the shell and thus to the ski.

The aim and objects mentioned, as well as other which will become apparent hereinafter, are achieved by a foot presser device, particularly for ski boots, comprising a wedge on which the foot rests inside the ski boot, at least one foot presser adapted to be acted on by actuating means, characterized in that said at least one presser spans said foot entirely and is connected to said wedge in at least one point.

BRIEF DESCRIPTION OF THE DRAWINGS

The above and further objects and advantages of the invention will be apparent from the following description of a preferred embodiment of the invention, illustrated in the accompanying drawings wherein:

FIG. 4 is a perspective illustration of a foot presser device according to another aspect of the invention;

FIG. 5 is a front elevational view of the device of FIG. 4;

DESCRIPTION OF THE PREFERRED EMBODIMENTS

Figure 3:
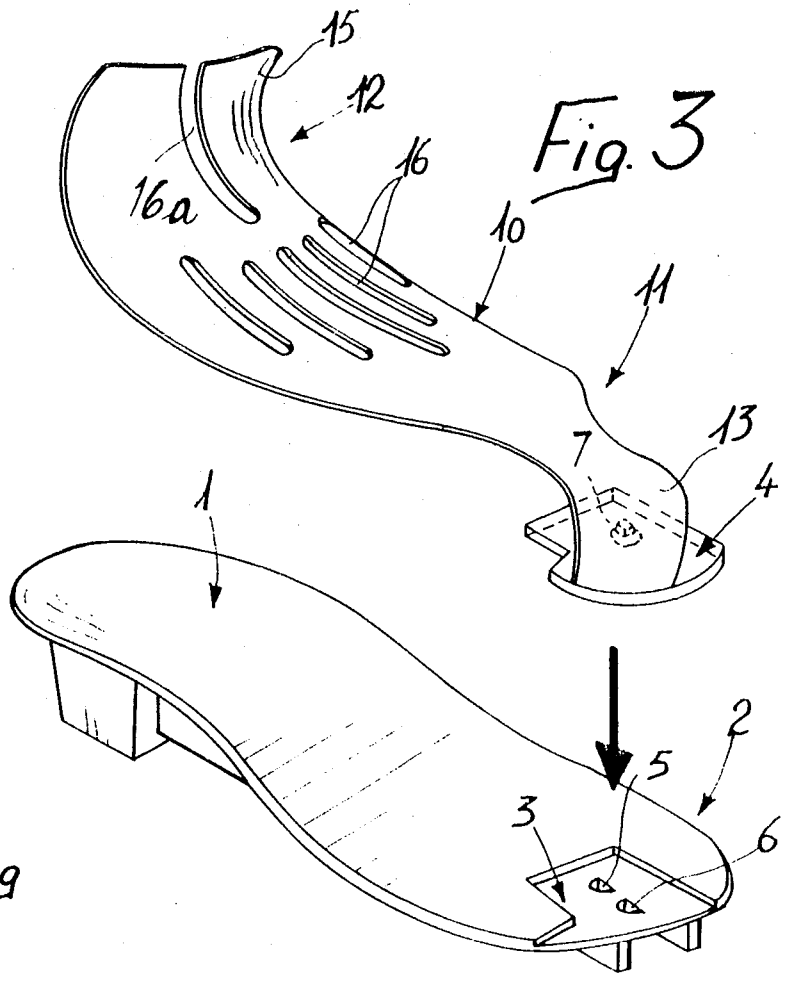
FIG. 3 is an exploded perspective view of the device.
Figure 1:
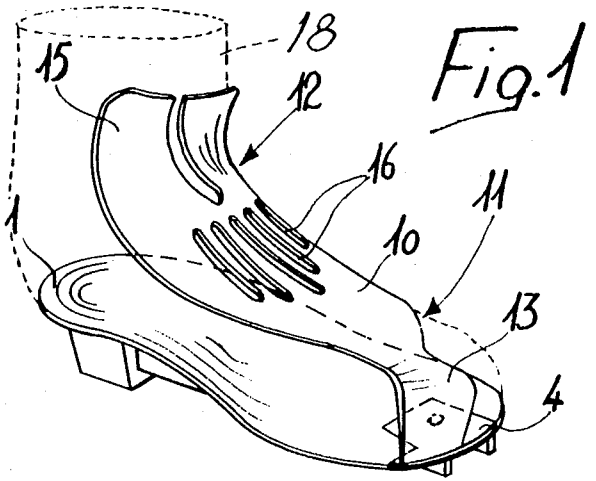
FIG. 1 is a perspective view of a foot presser device according to the invention.
Figure 2:
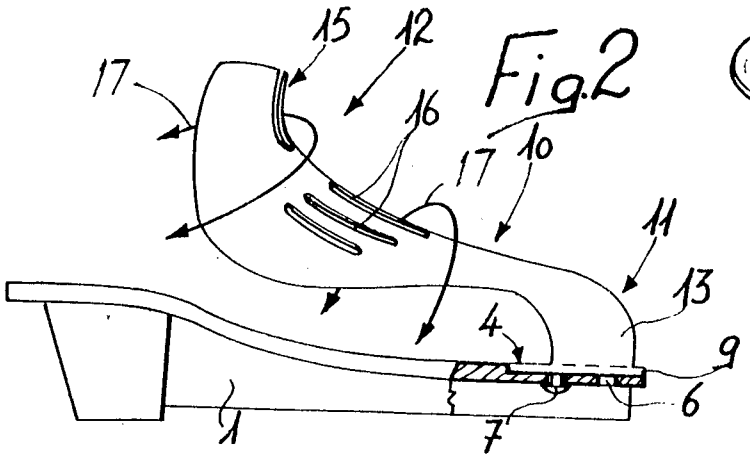
FIG. 2 is a side elevational view, partially in section, of the device.

With reference to FIGS. 1–3 the device according to the invention comprises a presser 10 connected to a wedge 1 adapted to be inserted into a ski boot shell.

The wedge 1 acts as a base plane for the foot while the presser 10 covers the foot entirely, from toe to instep, and it is anatomically shaped.

An inner shoe 18, schematically indicated with dotted lines in FIG. 1, can be inserted between the presser 10 and the wedge 1 so that the foot presser device is located between the inner shoe 18 and the ski boot shell.

The presser 10 is substantially constituted by an instep portion 12 and a front portion 11; to the front portion 11 a tab 13 is connected holding a base plate 4.

The base plate 4 is adapted to insert into a complementarily shaped seat 3, provided on the front section of the wedge 1, so that the presser 10 can be removably associated to the wedge 1.

For this purpose the base plate 4 is provided, on its lower side, with a lug 7 adapted to be inserted, in a snap-together manner, into a hole provided at the seat 3. Advantageously, more than one hole can be provided at the seat 3 in order to vary the position of the presser 10 relatively to the wedge 1 according to the foot size. For example, as illustrated in FIGS. 2 and 3, two holes 5, 6 can be provided at the seat 3 in such a way that the presser 10 can be connected to the wedge 1 in two different positions along the longitudinal axis of the ski boot.

The two different positions provide a variation of the working length of the device such that at least two different sizes of the inner shoe can fit into the foot presser device. This way only one type of device is sufficient for at least two different ski boot sizes. Obviously, the number of holes provided at the seat 3 can be any according to the specific needs.

As previously mentioned, the presser 10 is anatomically shaped; to increase the ability of the presser to envelop the foot, in order to distribute the pressure as evenly as possible, the presser 10 is provided with longitudinal slots 16 preferably located at a region between the instep portion 12 and the front portion 11; also a further slot **16*a* is provided at the instep portion 12**.

Actuating means of any known type can be utilized in the ski boot to act upon the presser 10 in order to exert a selected pressure on the foot.

In FIG. 2 the arrows 17 schematically illustrate a possible position and action of the actuating means such as, for example, a pair of cables enveloping the upper side of the presser 10 in a known manner.

In FIGS. 4–5 a foot presser device, according to another aspect of the invention, is illustrated comprising two symmetrically similar pressers **110*a* and 110*b*. The two pressers 110*a* and 110*b* being similar, only one presser, 110*a*, will be described in detail, the other presser 110*b* having the same parts as 110*a*** designated by the same number.

The presser **110*a* is substantially constituted by a front portion 111*a* and an instep portion 112*a* and is connected to a wedge 101 by means of a lateral tab 113*a*. In figures the pressers 110*a* and 110*b* are illustrated as being rigidly associated with the wedge 101, they can be made in one piece with the wedge 101**, for example by casting, but they can also be removably associated with the wedge for example in the manner described previously.

The tab 113*a* is connected to the border 118 of the wedge 101 and it folds over the foot so that the two pressers 110*a* and 110*b* overlap each other at least partially enveloping the foot along its entire length. Naturally the pressers are made of a sufficiently elastic material in order to adapt themselves to the foot shape.

As previously described, actuating means act upon the pressers in order to exert a selected pressure on the foot; as schematically illustrated by the arrows 117, the pressers 110*a* and 110*b* are made to slide one upon the other effectively enveloping the foot until the desired pressure is exerted on the same.

It has been seen as the invention achieves the aim and objects proposed by providing a foot presser device which effectively distributes the pressure evenly on the foot thus blocking it in an optimum manner.

This gives the skier an increased control of the ski and an improved comfort in wearing the ski boot even for a long period.

The device according to the invention is furthermore very easily and reliably assembled in any type of ski boot.

Naturally, the invention is susceptible to numerous modifications and variations, all of which are within the scope of the same inventive concept.

We claim:

1. In combination, a wedge and a foot presser device, particularly for ski boots, said wedge having a border and a longitudinal extension and being adapted to be inserted into a ski boot, said border including at least one lateral border portion and at least one other lateral border portion, said foot presser device comprising at least one presser and at least one other presser, said one presser and said other presser each having at least one front portion, at least one instep portion, and at least one lateral tab, said lateral tab of said one presser being rigidly associated with said one lateral border portion, said lateral tab of said other presser being rigidly associated with said other lateral border portion, said at least one presser and said at least one other presser at least partially overlapping each other and defining an overlapping zone, said one presser and said other presser engaging each other in mutually sliding engagement relationship at said overlapping zone, said overlapping zone extending in a direction substantially parallel to said longitudinal extension of said wedge.

2. A combination according to claim 1, wherein said instep portion of said one presser overlaps said instep portion of said other presser, and wherein said front portion of said one presser overlaps said front portion of said other presser.

3. A combination according to claim 1, wherein said lateral tab of said one presser extends laterally from between said front portion and said instep portion thereof to said one lateral border portion of said wedge, and wherein said lateral tab of said other presser extends laterally from between said front portion and said instep portion thereof to said other lateral border portion of said wedge.

4. A combination according to claim 2, wherein said one presser at least partially overlaps said lateral tab of said other presser, and wherein said other presser at least partially overlaps said lateral tab of said one presser.

5. A combination according to claim 1, wherein said instep portion and said front portion of said one presser and said instep portion and said front portion of said other presser extend substantially parallel to said longitudinal extension of said wedge.

6. A combination according to claim 3, wherein said lateral tab of said one presser and said one lateral border portion of said wedge are located substantially opposite said lateral tab of said other presser and said other lateral border portion of said wedge.

7. In combination, a foot instep presser and a wedge particularly for ski boots, said wedge being adapted for insertion into a ski boot shell to define a foot base plane and comprising;

a front section, at least one seat formed on said front section, and, at least one hole formed in said seat, said instep presser comprising;

an instep portion, a front portion connected to said instep portion to define together therewith, a substantially anatomic shape adapted to completely cover a foot from toe to instep, at least one downwardly projecting tab connected to said front portion, at least one rearwardly projecting base plate connected to said tab, extending beneath said front portion of said instep presser and being inserted into said seat formed on said front section of said wedge, a lower side defined by said base plate, and, at least one lug protruding downwardly from said lower side of said base plate and being adapted for snap-together engagement with said at least one hole formed in said seat.

* * * * *